US010716420B2

(12) United States Patent
Ramzan

(10) Patent No.: US 10,716,420 B2
(45) Date of Patent: Jul. 21, 2020

(54) COOLING STRAW AND BEVERAGE CONTAINER LID ACCOMMODATING A COOLING STRAW

(71) Applicant: Chaudhary M. Ramzan, Orange, CT (US)

(72) Inventor: Chaudhary M. Ramzan, Orange, CT (US)

( * ) Notice: Subject to any disclaimer, the term of this patent is extended or adjusted under 35 U.S.C. 154(b) by 88 days.

(21) Appl. No.: 15/810,968

(22) Filed: Nov. 13, 2017

(65) Prior Publication Data

US 2018/0132642 A1 May 17, 2018

Related U.S. Application Data

(60) Provisional application No. 62/421,605, filed on Nov. 14, 2016, provisional application No. 62/538,353, filed on Jul. 28, 2017.

(51) Int. Cl.
*A47G 21/18* (2006.01)

(52) U.S. Cl.
CPC ..... *A47G 21/187* (2013.01)

(58) Field of Classification Search
CPC ..... A47G 21/00–187
See application file for complete search history.

(56) References Cited

U.S. PATENT DOCUMENTS 2,570,366 A * 10/1951 Mitchell ..... A47G 21/183 239/33
2,943,794 A 7/1960 Sussman
5,409,131 A * 4/1995 Phillips ..... A47G 19/2272 215/388
7,537,173 B1 5/2009 Kogan
8,025,242 B2 9/2011 Efremkin et al.
8,851,324 B2 10/2014 O'Sullivan
9,005,684 B2 * 4/2015 Baron ..... A47G 21/183 426/85

(Continued)

FOREIGN PATENT DOCUMENTS

EP 0 327 244 A1 8/1989
WO 2016174108 A1 3/2016

OTHER PUBLICATIONS

International Search Report and Written Opinion for PCT Serial No. PCT/US17/61347 dated Feb. 9, 2018.

*Primary Examiner* — Kareen K Thomas
(74) *Attorney, Agent, or Firm* — McCormick, Paulding & Huber PLLC

(57) ABSTRACT

A beverage container accommodating a cooling straw for dispersing heat while consuming a hot beverage from a cup or other container. A beverage container lid includes a cover portion for covering an interior chamber of a cup, a flange extending downwardly from the cover portion, and a cooling straw comprising a distal portion and proximal portion, the distal portion includes an uptake hole formed therein, and the proximal portion includes a plurality of cooling holes formed therein. The cooling straw may also include an intermediate portion disposed between the distal portion and the proximal portion, the distal portion including a plurality of uptake holes formed therein, and the intermediate portion or the proximal portion includes a plurality of cooling holes formed therein. The cooling straw may also include at least one bendable section.

20 Claims, 13 Drawing Sheets

(56) References Cited

U.S. PATENT DOCUMENTS

| | | | | |
|---|---|---|---|---|
| 2004/0182461 | A1* | 9/2004 | Margetson ..... | A47G 21/188<br>138/109 |
| 2008/0305226 | A1 | 12/2008 | Catena et al. | |
| 2009/0041904 | A1 | 2/2009 | Baron | |
| 2014/0103037 | A1 | 4/2014 | Strominger | |
| 2015/0353240 | A1 | 12/2015 | Nelms | |

* cited by examiner

COOLING STRAW AND BEVERAGE CONTAINER LID ACCOMMODATING A COOLING STRAW

CROSS-REFERENCE TO RELATED APPLICATIONS

This application claims priority to U.S. Provisional Patent Application No. 62/421,605, filed Nov. 14, 2016, and U.S. Provisional Patent Application No. 62/538,353, filed Jul. 28, 2017, each of which is hereby incorporated by reference in its entirety.

TECHNICAL FIELD

The present invention relates generally to beverage containers and cooling straws and, more particularly, to beverage container lids accommodating cooling straws.

BACKGROUND

Traditional beverage containers include a cup with an attached lid to contain and facilitate consumption of a beverage. The lid typically includes a cover portion with a hole therein to allow drinking, while preventing the beverage from spilling out of the cup. Some beverages are best consumed at hot temperatures. However, a beverage contained in a traditional beverage container may have a temperature hot enough to burn, scald or cause other injuries to a consumer drinking the beverage. Thus, it is often desirable to partially cool the beverage prior to being consumed. One approach to cooling the beverage is to remove the lid from the cup, thereby allowing the beverage to cool. However, when the lid is removed from the cup, the lid cannot prevent the beverage from spilling out of the cup. Further, exposing the beverage directly to the atmosphere may cool the beverage too much and too quickly, thereby shortening the length of time the beverage remains hot. Therefore, there is a need for an improved approach to consuming hot beverages.

SUMMARY

According to principles of the present disclosure, a beverage container lid includes a cover portion for covering an interior chamber of a cup, a flange extending downwardly from the cover portion and including a mating geometry for securing the beverage container lid to a cup, and a cooling straw, the cooling straw including a distal portion and proximal portion, the distal portion including an uptake hole formed therein, and the proximal portion including a plurality of cooling holes formed therein.

According to principles of the present disclosure, a cooling straw for use with a beverage container lid configured for accommodating the cooling straw, the cooling straw includes a distal portion, a proximal portion, and an intermediate portion disposed between the distal portion and the proximal portion, the distal portion includes a plurality of uptake holes formed therein, and the intermediate portion or the proximal portion includes a plurality of cooling holes formed therein.

According to principles of the present disclosure, a beverage container lid accommodating a cooling straw includes a distal portion, a proximal portion, and an intermediate portion disposed between the distal portion and the proximal portion, the beverage container lid including a straw hole with the cooling straw extending therethrough, a cover portion for covering an interior chamber of a cup, and a flange extending downwardly from the cover portion, the distal portion of the straw includes a plurality of uptake holes formed therein, and the proximal portion or the intermediate portion of the straw includes a plurality of cooling holes formed therein.

These and other aspects, features and advantages of the present disclosure will be apparent in light of the following detailed description of non-limiting embodiments, with reference to the accompanying drawings.

DETAILED DESCRIPTION

Figure 1:
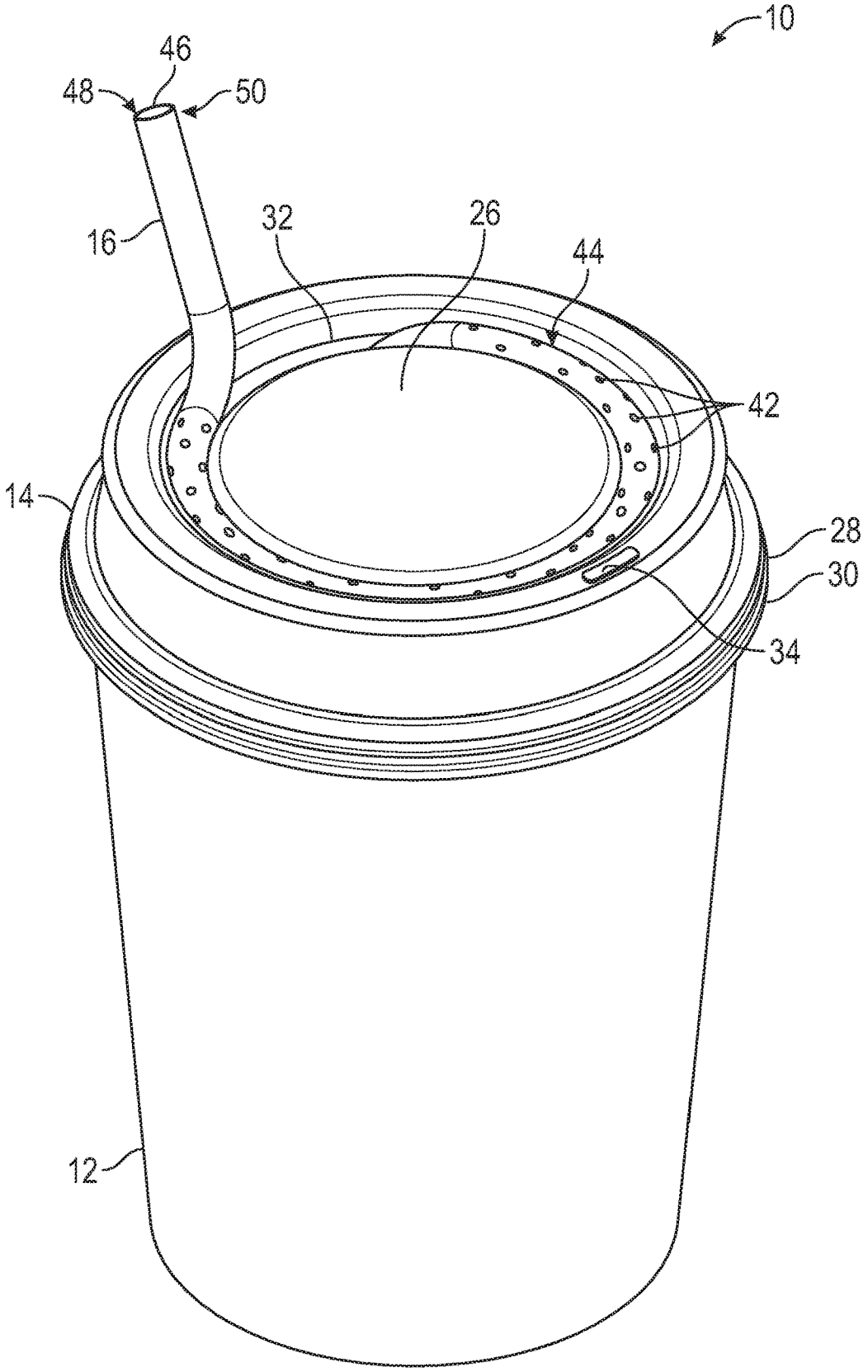
FIG. 1 is a front, right and top perspective view of an exemplary beverage container, lid and cooling straw according to the present disclosure.

Referring to FIGS. 1-4, a beverage container 10 includes a cup 12 and a lid 14 for securely closing the cup 12. The lid 14 is configured to permit a cooling straw 16 to extend therethrough via a straw hole 18 formed therein. The cup 12 includes an interior chamber 20 for housing a liquid or beverage 22 therein and a rolled lip 24 encircling the top of the cup 12 for engaging the lid 14. The lid 14 includes a cover portion 26 for covering the interior chamber 20 of the cup 12 and a flange 28 extending downwardly from the cover portion 26 to engage the rolled lip 24 of the cup 12. The flange 28 includes mating geometry 30 to securely mate with the rolled lip 24 of the cup 12 to form a tight engagement therebetween. The lid 14 includes a recess 32 in the cover portion 26 that is sized and shaped to accommodate a portion of the cooling straw 16. The lid 14 may optionally include a drinking slot 34 formed in the cover portion 26.

Figure 2:
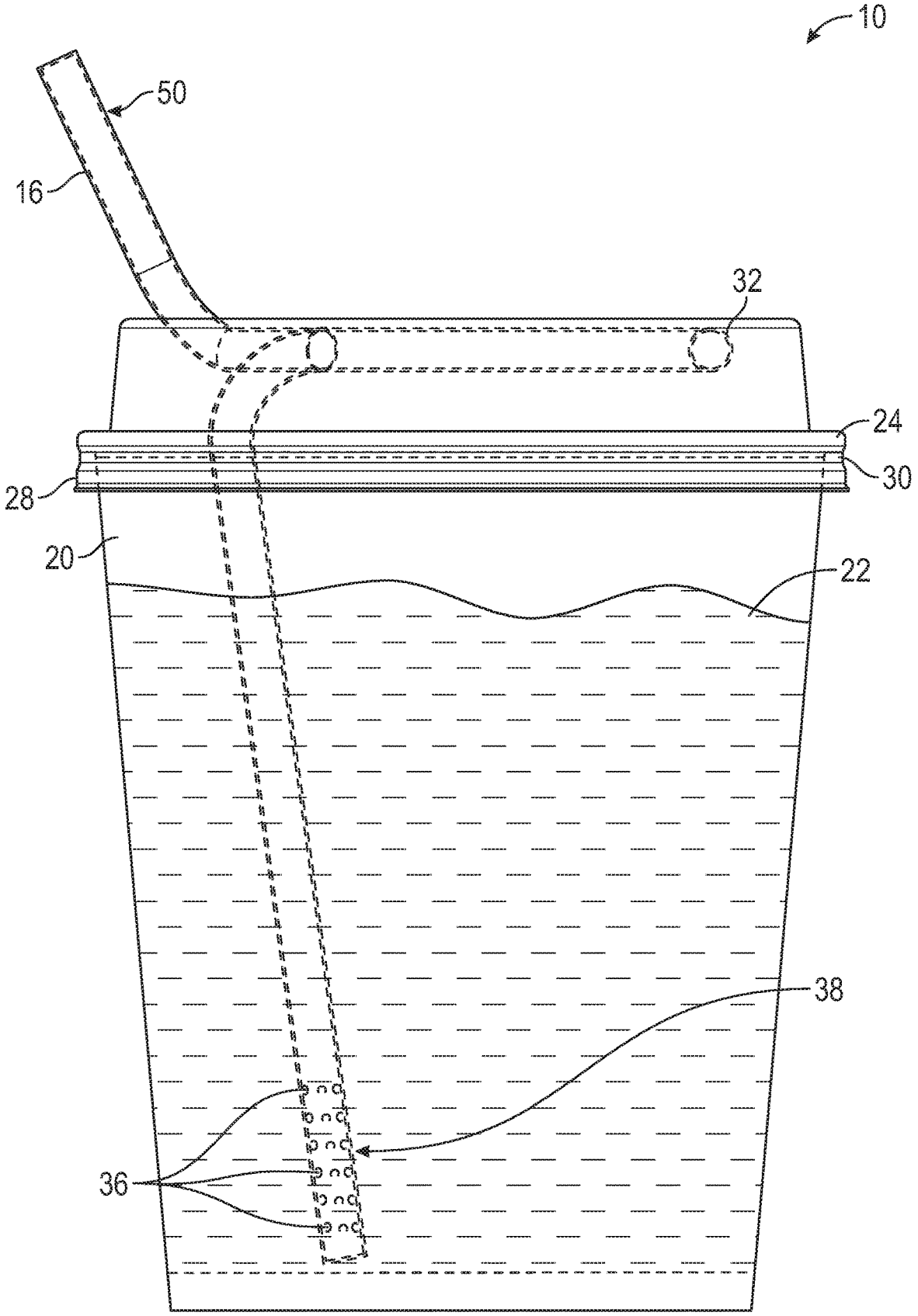
FIG. 2 is a front, partially see-through view of the beverage container, lid and cooling straw shown in FIG. 1.
Figure 3:
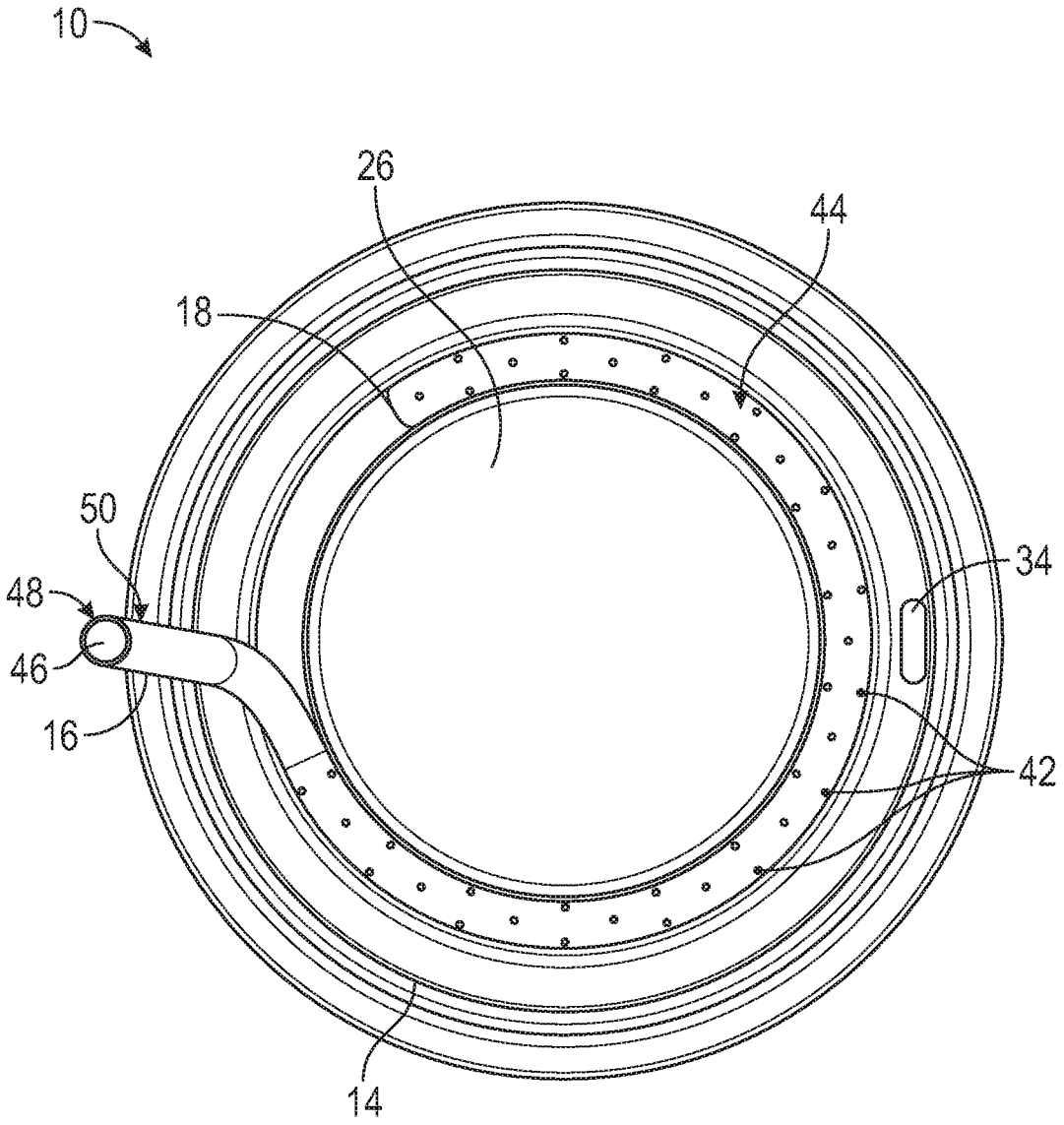
FIG. 3 is a top view of the beverage container, lid and cooling straw shown in FIG. 1.
Figure 4:
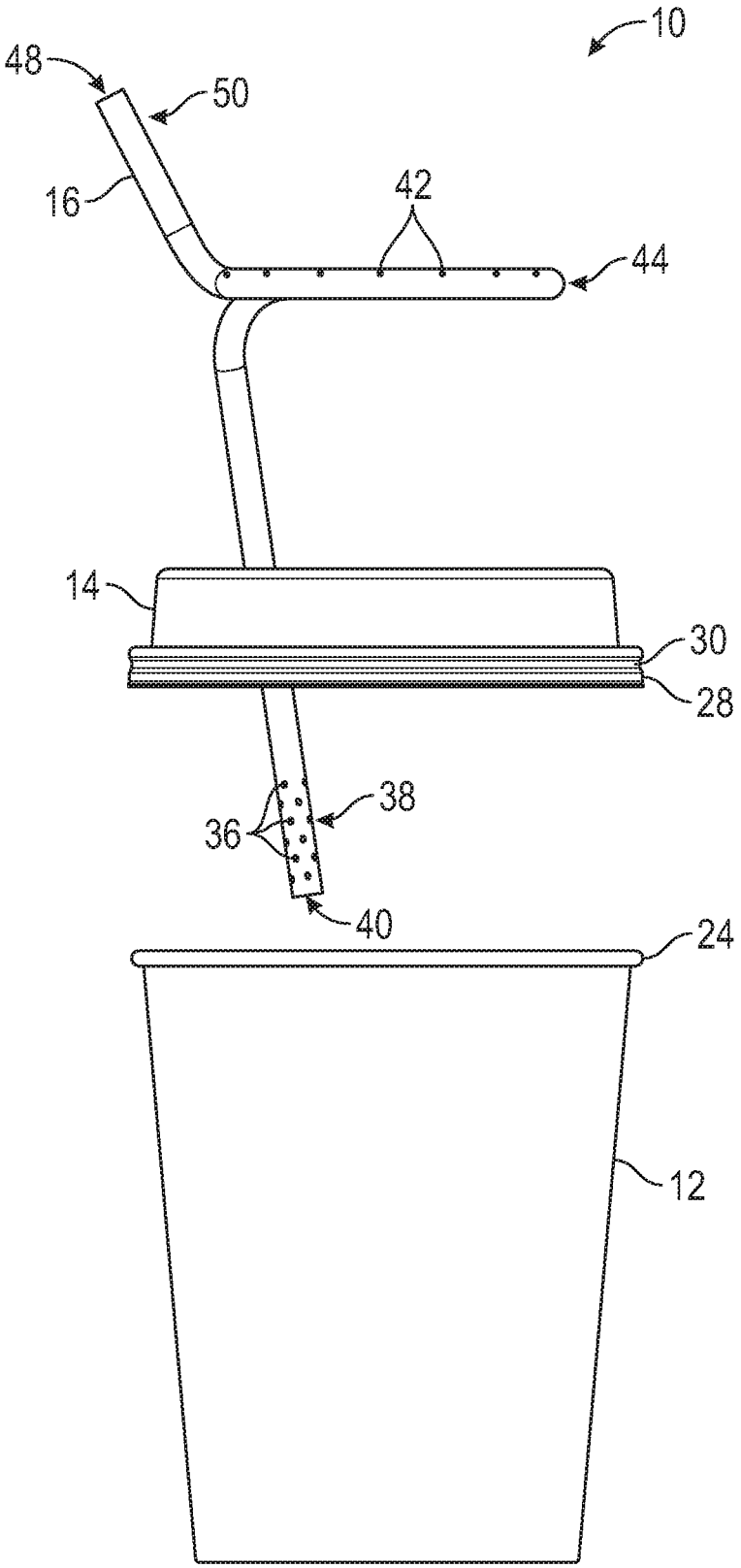
FIG. 4 is an exploded view of the beverage container, lid and cooling straw shown in FIG. 1.
Figure 5:
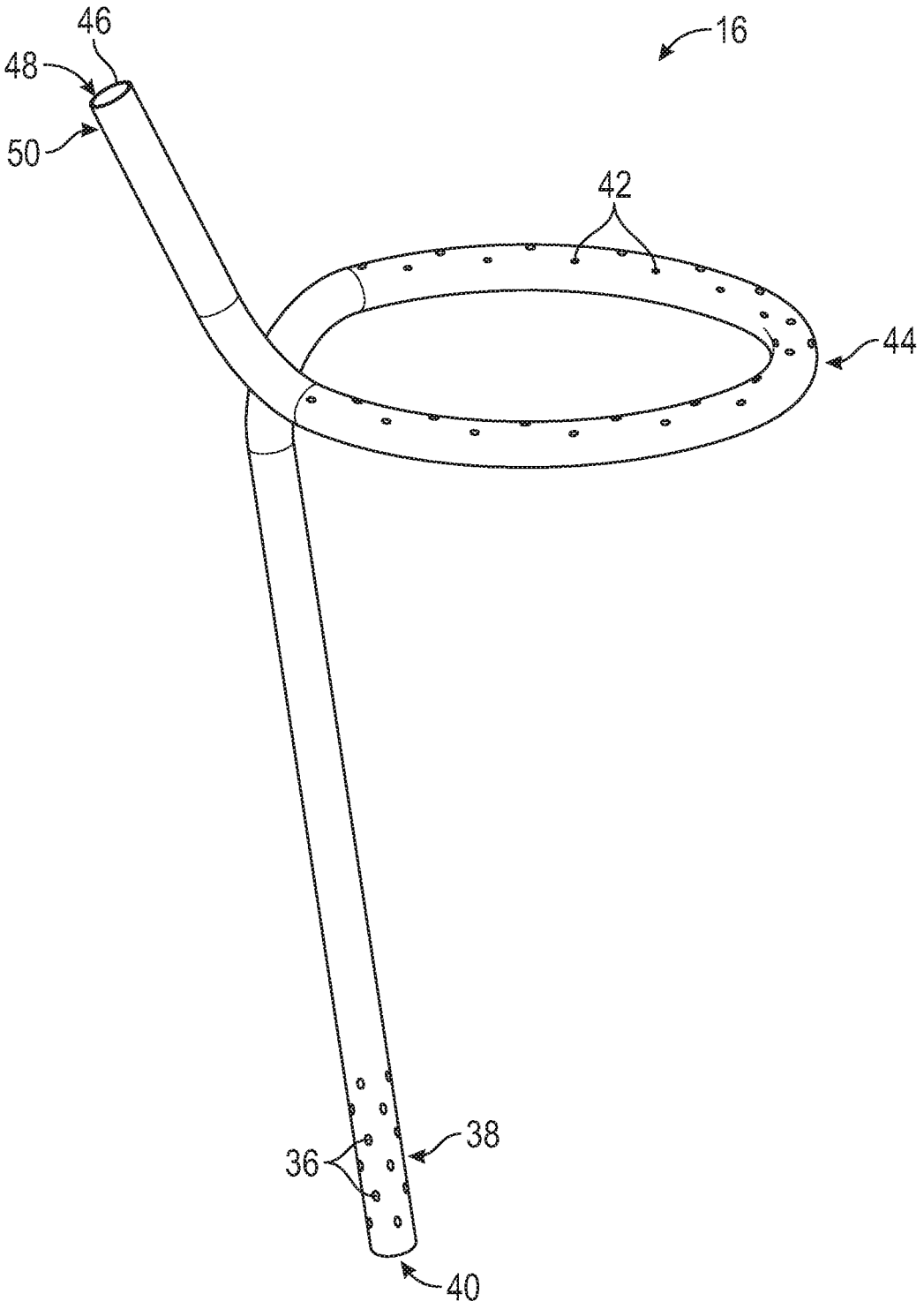
FIG. 5 is a front, top perspective view of the cooling straw shown in FIG. 1.

Referring to FIGS. 2, 4 and 5, the cooling straw 16 includes a plurality of uptake holes 36 formed therein at a distal portion 38 of the cooling straw 16 configured to be disposed in the interior chamber 20 of the cup 12. The distal portion 38 is substantially at and/or near a distal end 40 of the cooling straw 16. Unlike conventional straws, the distal end 40 of the cooling straw 16 may be closed. The uptake holes 36 may be circular holes approximately 0.3 mm to 1.3 mm in diameter size. The cooling straw 16 includes a plurality of cooling holes 42 at an intermediate portion 44 of the cooling straw 16. The intermediate portion 44 of the cooling straw 16 is accommodated in the recess 32 formed in the lid 14 outside the chamber 20. To ensure unobstructed air flow, the cooling holes 42 may be located in areas of the intermediate portion 44 of the cooling straw 16 that are not in contact with the lid 14. The cooling holes 42 may be circular holes approximately 0.3 mm to 1.3 mm in diameter size. Similar to a conventional straw, the cooling straw 16 includes an exit hole 46 formed at a proximal end 48 of a proximal portion 50 of the cooling straw 16. The exit hole 46 may be approximately 0.57 cm in size.

In operation, hot beverage 22 is placed into the interior chamber 20 of the beverage container cup 12. The beverage container lid 14 is then secured to the beverage container cup 12 by mating the mating geometry 30 of the flange 28 of the lid 14 with the rolled lip 24 of the cup 12. The drinking slot 34, if present, may function as a vent, allowing thermal energy, in the form of steam and/or other vapor, to escape from the contained beverage 22 to the atmosphere. When hot beverage 22 is leaving the cup 12 through the cooling straw 16, the vent hole 34, if present, may also function to allow pressure within the cup 12 to achieve equilibrium with the ambient pressure exterior to the cup 12, or atmospheric pressure by allowing air to be drawn into the chamber 20.

The distal end 40 of the cooling straw 16 is inserted into the straw hole 18 of the lid 14 and slidably moved relative to the lid 14 until the intermediate portion 44 reaches the lid 14. The straw 16 is then secured to the lid 14 by snapping the intermediate portion 44 of the cooling straw 16 into the recess 32 in the lid 14. The recess 32 is sized and shaped to form as a snap fit with the intermediate portion 44 due to the appropriate size and shape of the recess 32 of the lid 14. The intermediate portion 44 may snap into the recess 32 by being pressed downward into the recess 32. Once pressed into the recess 32 of the lid 14, the cooling straw 16 is firmly retained by the lid 14 and not freely movable relative to the lid 14.

The consumer may drink from the beverage container 10 by placing his/her lips onto the proximal portion 50 of the cooling straw 16 so that their lips cover the exit hole 46. The consumer may then generate a suction force at the exit hole 46 of the cooling straw 16, which generates a suction force at the plurality of uptake holes 36 at the distal portion 38 of the cooling straw 16 as well as the cooling holes 42. The suction force causes the hot beverage 22 to enter the cooling straw 16 through one or more of the plurality of uptake holes 36 and causes air to enter the cooling straw 16 through the cooling holes 42. The hot beverage 22, due to the suction force generated by the consumer, moves up through the cooling straw 16 into and through a channel defined by the intermediate portion 44. While the hot beverage 22 is in the channel defined by the intermediate portion 44, the air from the atmosphere entering the cooling straw 16 through cooling holes 42 mixes with the hot beverage 22. As long as this atmospheric air is at a lower temperature than the hot beverage 22, thermal energy is transferred from the hot beverage 22 to the air, thereby cooling the hot beverage 22 as it passes through the intermediate portion 44. The hot beverage 22 then travels to the exit hole 46 and into the consumer's mouth at a temperature cooler than the temperature of the hot beverage 22 contained in the cup 12 due to the cooling in the intermediate portion 44. In addition, the mixing of the air from outside the beverage container cup 12 with the hot beverage 22 in the intermediate portion 44 causes the beverage to become foamy and more tasteful for the consumer before traveling to the consumer's mouth.

The cooling straw 16 may be removed from the lid 14 by pulling the straw 16 away from the lid 14 until the intermediate portion 44 snaps out of the recess 32. Once the intermediate portion 44 is removed from the recess 32 of the lid 14, the cooling straw 16 is freely movable relative to the lid 14. When the cooling straw 16 is removed, the beverage container 10 may be operated by a consumer by placing his/her lips to the drinking slot 34, if present, and tipping the beverage container 10 so that the hot beverage 22 flows into the consumer's mouth through drinking slot 34.

While the uptake holes 36 and cooling holes 42 have been described as being approximately 0.3 to 1.3 mm in size, it should be readily understood that the uptake holes 36 and/or cooling holes 42 may be of smaller or larger sizes depending upon the intended application of the cooling straw 16. Similarly, the exit hole 46 may also be smaller or larger in size.

While the general shape of the intermediate portion 44 of the cooling straw 16 is shown to be substantially circular and extending along a radially outer portion of the lid 14, it should be readily understood that the cooling straw 16 may be differently sized and shaped. For example, the cooling straw 16 could be constructed to have a zig-zag shape, triangular shape, oval shape or the like. Depending on the chosen shape of the cooling straw 16, the lid 14 should be similarly constructed such that the recess 32 has a corresponding size, shape and design so that the recess 32 may accommodate the cooling straw 16, and form a snap-fit therewith, as described above.

While the cooling straw 16 has been described as having a closed distal end 40, an alternative option is to include one or more uptake holes 36 in the distal end 40 instead of, or in addition to, the uptake holes 36 formed in the distal portion 38 of the cooling straw 16. When uptake holes 36 are formed in the distal end 40, the distal end 40 may not be as open as conventional straw openings due to the size of the uptake holes 36 being smaller than conventional straw openings.

Figure 6:
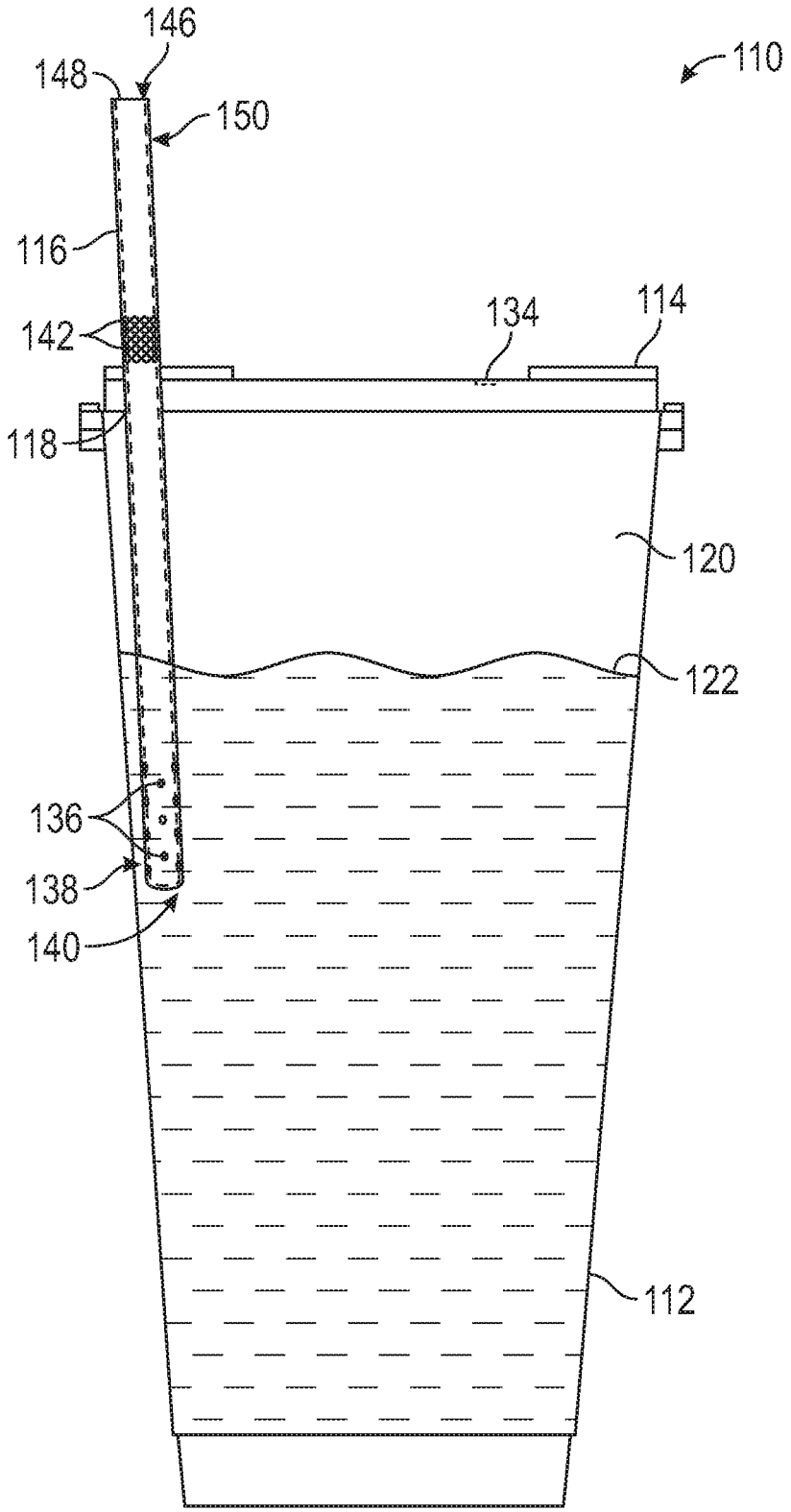
FIG. 6 is a front, partially see-through view of another exemplary beverage container, lid and cooling straw according to the present disclosure.

Referring to FIG. 6, wherein like reference numerals represent like elements, a beverage container 110 includes a cup 112 and a lid 114 for securely closing the cup 112. The lid 114 is configured to permit a cooling straw 116 to extend therethrough via a straw hole 118 formed therein. The cup 112 includes an interior chamber 120 for housing a liquid or beverage 122 therein and a rolled lip 124 encircling the top of the cup 112 for engaging the lid 114. The lid 114 includes a cover portion 126 for covering the interior chamber 120 of the cup 112 and a flange 128 extending downwardly from the cover portion 126 to engage the rolled lip 124 of the cup 112. The flange 128 includes mating geometry 130 to securely mate with the rolled lip 124 of the cup 112 to form a tight engagement therebetween. The lid 114 may include a vent hole 134 formed in the cover portion 126.

The cooling straw 116 includes a plurality of uptake holes 136 formed therein at a distal portion 138, configured to be disposed in chamber 120, of the cooling straw 116. The distal portion 138 is substantially at and/or near a distal end 140 of the cooling straw 116. Unlike conventional straws, the distal end 140 of the cooling straw 116 may be closed. The uptake holes 136 may be approximately 0.3 to 1.3 mm in size. The cooling straw 116 includes a plurality of cooling holes 142 at an intermediate portion 144 of the cooling straw 116. The intermediate portion 144 of the cooling straw 116 is a length of the cooling straw 116 that is above the lid 114 when the cooling straw 116 is in an inserted position, as shown in FIG. 6, with a portion of the cooling straw 116 extending into the cup 112 through the lid 114. The cooling holes 142 may also be approximately 0.3 to 1.3 mm in size. The cooling straw 116 includes an exit hole 146 formed at a proximal end 148 of a proximal portion 150 of the cooling straw 116. The exit hole 146 may be approximately 0.57 cm in size.

In operation, hot beverage 122 is placed into the interior chamber 120 of the beverage container cup 112. The beverage container lid 114 is then secured to the beverage container cup 112 by mating the mating geometry 130 of the flange 128 of the lid 114 with the rolled lip 124 of the cup 112. The vent hole 134, if present, may function as a vent, allowing thermal energy, in the form of steam and/or other vapor, to escape from the contained beverage 22 to the atmosphere. When hot beverage 122 is leaving the cup 112 through the cooling straw 116, the vent hole 134 may also function to allow pressure within the cup 112 to achieve equilibrium with the ambient pressure exterior to the cup 112, or atmospheric pressure by allowing air to be drawn into the chamber 120.

The distal end 140 of the cooling straw 116 is inserted into the straw hole 118 of the lid 114 and slidably moved relative to the lid 114 until the intermediate portion 144 reaches the lid 114. The consumer may drink from the beverage container 110 by placing his/her lips onto the proximal portion 150 of the cooling straw 116 so that their lips cover the exit hole 146. The consumer may then generate a suction force at the exit hole 146 of the cooling straw 116, which generates a suction force at the plurality of uptake holes 136 at the distal portion 138 of the cooling straw 116 as well as the cooling holes 142. The hot beverage 122 enters the cooling straw 116 through one or more of the plurality of uptake holes 136 and air enters through the cooling holes 142. The hot beverage 122, due to the suction force generated by the consumer, moves up through the cooling straw 116 into and through a channel defined by the intermediate portion 144. While the hot beverage 122 is in the channel defined by intermediate portion 144, the air from the atmosphere entering the cooling straw 116 through cooling holes 142 mixes with the hot beverage 122. If the air is at a lower temperature than the hot beverage 122, thermal energy transfers from the hot beverage 122 to the air, thereby cooling the hot beverage 122 as it passes the intermediate portion 144. The hot beverage 122 then travels to the exit hole 146 and into the consumer's mouth at a temperature cooler than the temperature of the hot beverage 122 contained in the cup 112 due to the cooling in the intermediate portion 144. In addition, the mixing of the air from outside the beverage container cup 112 with the hot beverage 122 in the intermediate portion 144 causes the beverage to become foamy and more tasteful for the consumer before traveling to the consumer's mouth.

While the cooling straw 116 has been described as having a closed distal end 140, an alternative option is to include one or more uptake holes 136 in the distal end 140 instead of, or in addition to, the uptake holes 136 formed in the distal portion 138 of the cooling straw 116. When uptake holes 136 are formed in the distal end 140, the distal end 140 may not be as open as conventional straw openings due to the size of the uptake holes 136 being smaller than conventional straw openings.

Figure 7:
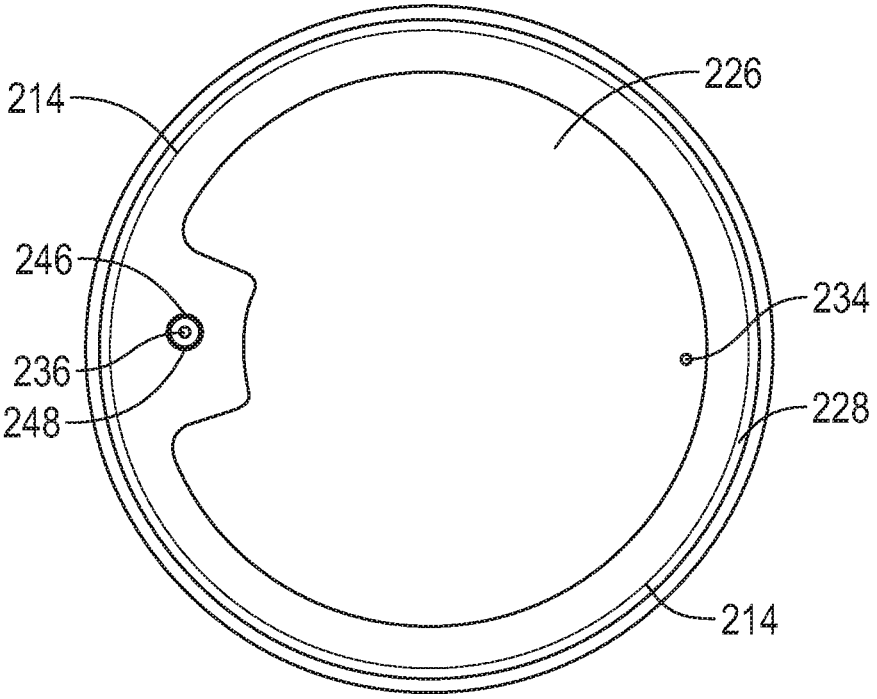
FIG. 7 is a top view of another exemplary lid and cooling straw according to the present disclosure.
Figure 8:
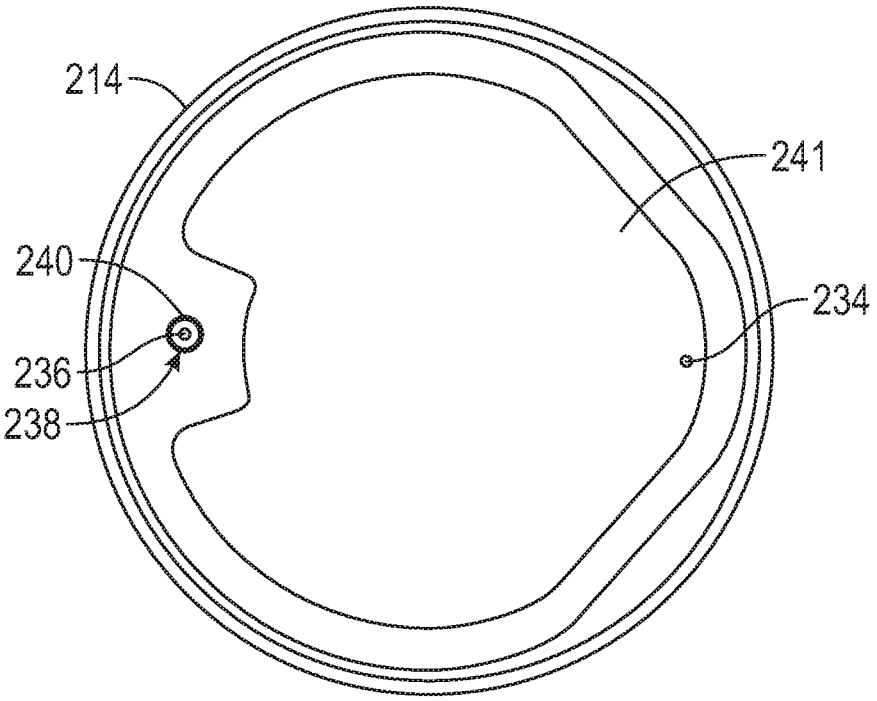
FIG. 8 is a bottom view of the lid and cooling straw shown in FIG. 7.
Figure 9:
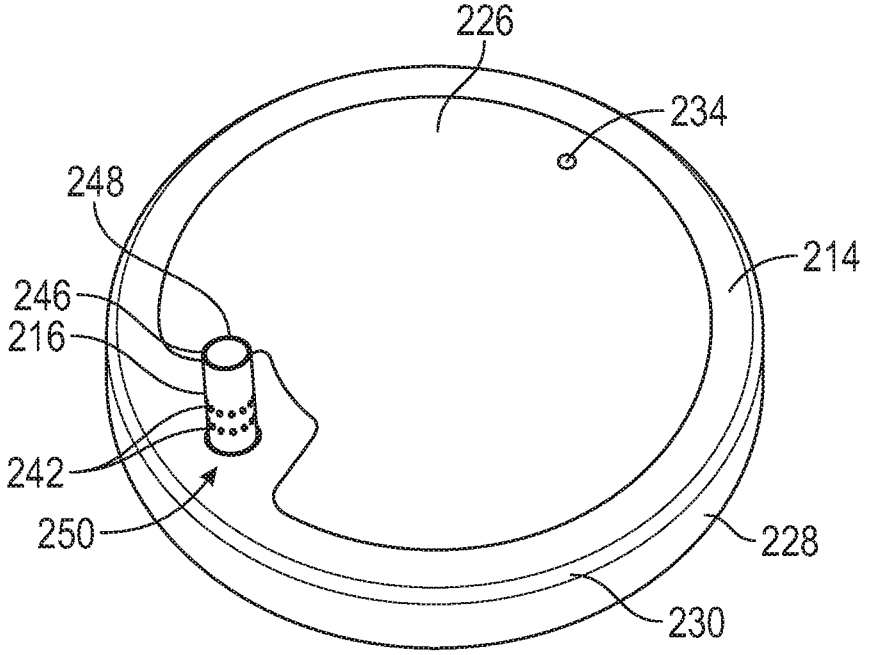
FIG. 9 is a front, left and top perspective view of the lid and cooling straw shown in FIG. 7.

Referring to FIGS. 7-9, wherein like reference numerals represent like elements, a lid 214 for securely closing a cup, such as cups 10, 110 shown in FIGS. 1 and 6 described above, includes a cooling straw 216. The cooling straw 216 is integrally formed with the lid 214. The lid 214 includes a cover portion 226 for covering an interior chamber of the cup and a flange 228 extending downwardly from the cover portion 226. The flange 228 includes mating geometry 230 to securely mate with a rolled lip of the cup. The lid 214 includes a vent hole 234 formed in the cover portion 226.

The cooling straw 216 has an uptake hole 236 formed in a distal portion 238 at a distal end 240 of the cooling straw 216 configured to be disposed in chamber 20, 120. The uptake hole 236 may be approximately 0.25-0.5 mm in size, for example, the hole 236 may be approximately 0.35 mm in size. However, the uptake hole 236 may be smaller or larger in size, as discussed above. The distal portion 238 extends from a bottom side 241 of the cover portion 226. The flange 228 extends to a greater distance from bottom side 241 of the cover portion 226 than the distance between the bottom side 241 and the distal end 240. The cooling straw 216 includes cooling holes 242 formed in a proximal portion 250 of the cooling straw. In an embodiment, the cooling holes 242 may be approximately 0.25-0.5 mm in size, for example, the holes 242 may be approximately 0.35 mm in size. However, the cooling holes 242 may be smaller or larger in size, as discussed above. The cooling straw 216 includes an exit hole 246 formed in a proximal end 248 of the cooling straw 216. The exit hole 246 may be approximately 6.00 mm in size.

In operation, hot beverage 22, shown in FIG. 2, is placed into a beverage container cup 10, 110, shown in FIGS. 2 and 6. The beverage container lid 214 is then secured to the beverage container cup 10, 110 shown in FIGS. 2 and 6 by mating the mating geometry 230 of the flange 228 of the lid 214 with a rolled lip of the cup. The vent hole 234 may function as a vent, allowing thermal energy, in the form of steam and/or other vapor, to escape from the contained beverage to the atmosphere.

The consumer may drink from the beverage container by placing his/her lips onto the proximal portion 250 of the cooling straw 216 so that their lips cover the exit hole 246. The beverage container is then tipped so that the beverage in the beverage cup contacts the lid 214 and the uptake hole 236. The beverage can exit the cup through the uptake hole 236. The consumer may generate a suction force to draw some of the beverage in the cup through the uptake hole 236 and to draw air in through the cooling holes 242. As the beverage 22, shown in FIG. 2, passes through the cooling straw 216, air from the atmosphere entering the cooling straw 216 through the cooling holes 242 mixes with the beverage 22, shown in FIG. 2. If the air is at a lower temperature than the beverage, thermal energy transfers from the beverage to the air, thereby cooling the beverage as air passes through the straw 216. The beverage then travels to the exit hole 246 and into the consumer's mouth at a temperature cooler than the temperature of the beverage contained in the cup. In addition, the mixing of the air from outside the beverage container cup with the hot beverage 22, shown in FIG. 2, in the cooling straw 216 causes the beverage to become foamy and more tasteful for the consumer before traveling to the consumer's mouth.

While the cooling straw 216 has been shown and described as being integrally formed with the lid 214, it should be readily understood that the cooling straw 216 may be constructed as a separate piece from the lid 214, with the lid 214 being configured to accept insertion of the cooling straw 216 by including a straw insertion hole formed therein.

Figure 10:
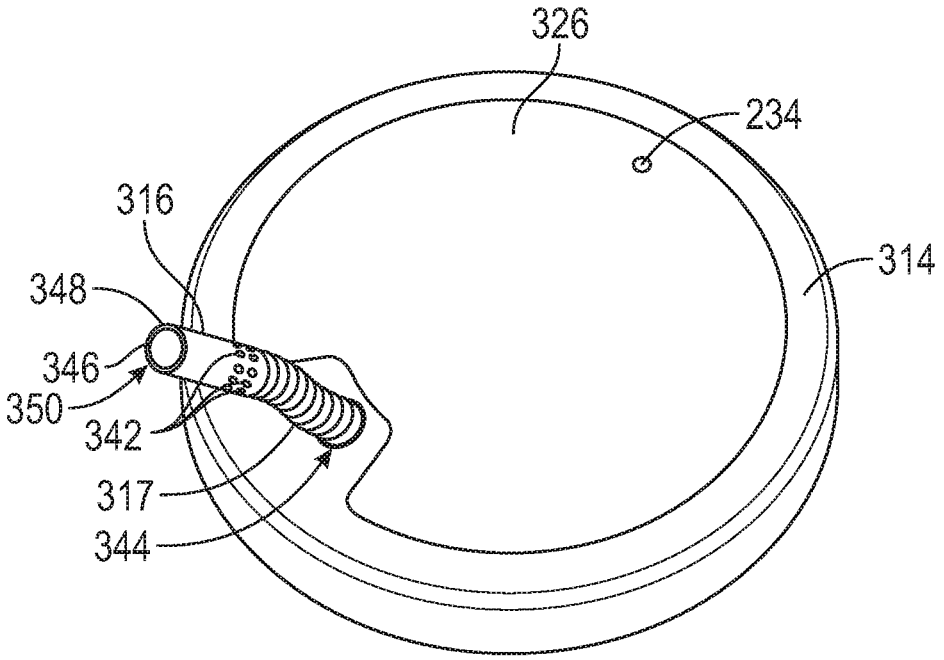
FIG. 10 is a front, left and top perspective view of another exemplary lid and cooling straw according to the present disclosure.

Referring to FIG. 10, wherein like reference numerals represent like elements, a lid 314 for securely closing a cup 12, 112, shown in FIGS. 1 and 6, includes a cooling straw 316. The lid 314 is substantially similar to the lid 214 shown in FIGS. 7-9, except that the cooling straw 316 includes a bendable section 317 at an intermediate portion 344 of the cooling straw 316. The bendable section 317 allows a proximal portion 350 of the cooling straw 316 to be moved to various positions and angles relative to the cover portion 326 of the lid 314. The freedom in movement provided by the bendable section 317 provides advantages during operation as well as the ability for multiple lids 314 to be arranged more compactly for, for example shipping and/or storage purposes.

While the bendable section 317 is shown substantially at or near the connection of the lid 314 and cooling straw 316, it should be readily understood that the bendable section 317 may be located at different areas of the cooling straw 316. For example, the bendable section 317 could be located at an area of the cooling straw 316 that is a distance away from the connection of the lid 314 and cooling straw 316. The cooling holes 342 may be adjusted to be at locations of the cooling straw 316 that are between the bendable section 317 and the lid 314, at the bendable section 317 and/or on the opposite side of the bendable section 317 from the lid 314.

The lid 314 and cooling straw 316 may be otherwise structurally configured in substantially the same manner as the lid 214 and cooling straw 216 shown in FIGS. 7-9. Thus, the operation of the lid 314 and cooling straw 316 when securely closing a cup containing a beverage is substantially the same as described above for the lid 214 and cooling straw 216 shown in FIGS. 7-9 and, therefore, will not be described in detail.

Figure 11:
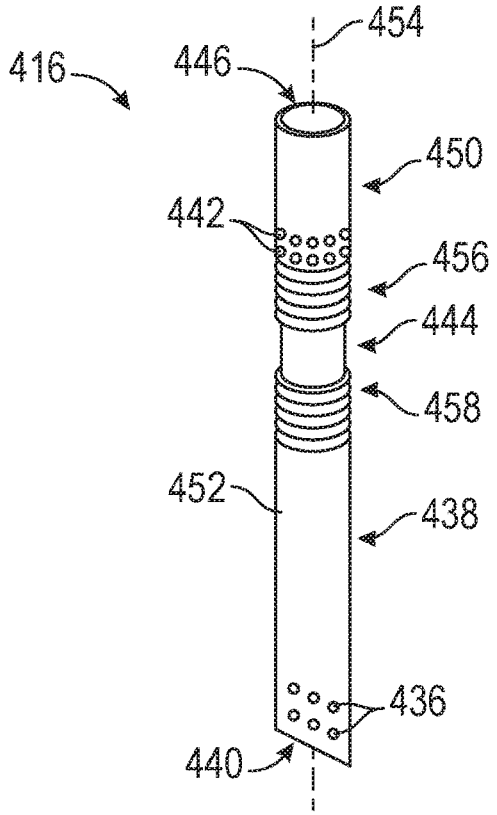
FIG. 11 is a front, top perspective view of an exemplary cooling straw in an unbent position according to the present disclosure.

Referring to FIG. 11, wherein like numerals represent like elements, a cooling straw 416 comprises a cooling straw body 452 extending in a longitudinal direction or axis 454. The cooling straw body 452 includes a distal portion 438, a first bendable section 456, an intermediate portion 444, a second bendable section 458 and a proximal portion 450 disposed in series along the longitudinal axis 454. The distal portion 438 comprises a closed end 440 and a plurality of uptake holes 436. The proximal portion 450 comprises an exit hole 446 and a plurality of cooling holes 442. The first bendable section 456 is positioned between the distal portion 438 and the intermediate portion 444. The second bendable section 458 is positioned between the intermediate portion 444 and the proximal portion 450.

In the unbent position, shown in FIG. 11, the cooling straw 416 is substantially linear in shape along axis 454. However, the first bendable section 456 may be bent to allow the distal portion 438 of the cooling straw 416 to be moved to various positions and angles relative to the intermediate portion 444. The second bendable section 458 may similarly be bent to allow the proximal portion 450 of the cooling straw 416 to be moved to various positions and angles relative to the intermediate portion 444.

Figure 12:
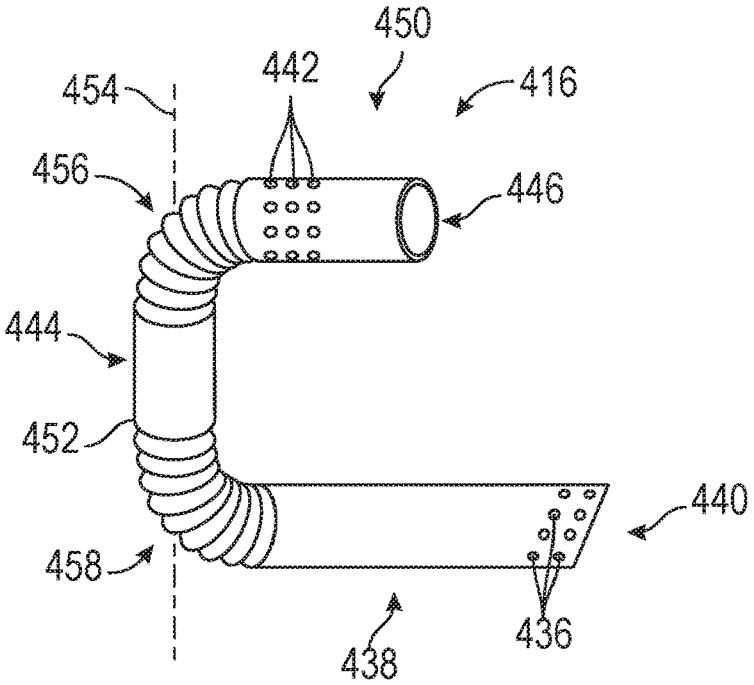
FIG. 12 is a front, top perspective view of the cooling straw of FIG. 11 in a bent position.

Referring to FIG. 12, in a bent position of the cooling straw 416, the first bendable section 456 is bent so that the proximal portion 450 of the cooling straw 416 is in a position substantially perpendicular to the longitudinal axis 454 and the second bendable section 458 is bent so that the distal portion 438 is substantially perpendicular to the longitudinal extension of the intermediate portion 444. Accordingly, in the bent position, the distal portion 438 and the proximal portion 450 extend in directions that are substantially parallel to each other.

Figure 13:
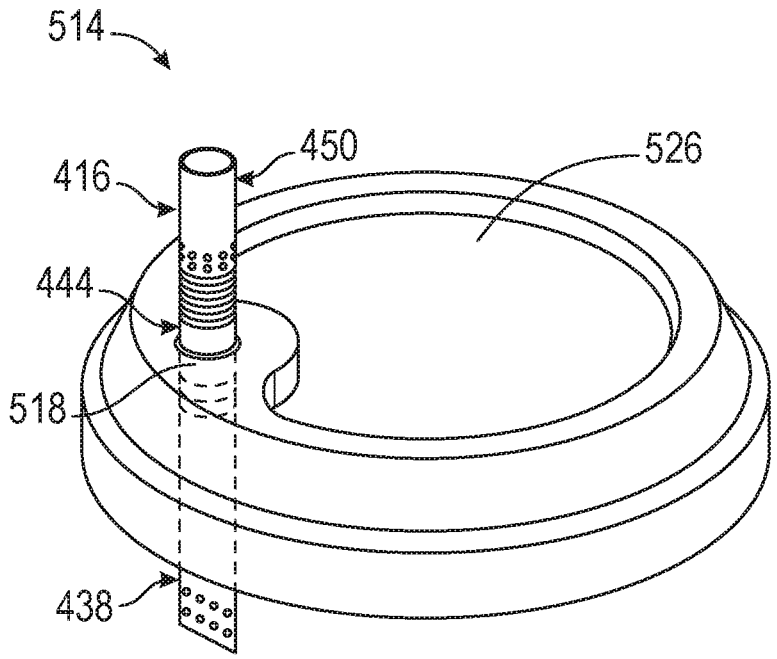
FIG. 13 is a front, top perspective view of the cooling straw of FIG. 11 inserted in a beverage container lid, with the cooling straw in an unbent position.

Referring to FIG. 13, the cooling straw 416 is shown inserted in an exemplary beverage container lid 514 through a straw hole 518, with the cooling straw 416 in the unbent position. In the unbent position, the cooling straw 416 is substantially perpendicular to a plane defined by a cover portion 526 of the beverage container lid 514.

Figure 14:
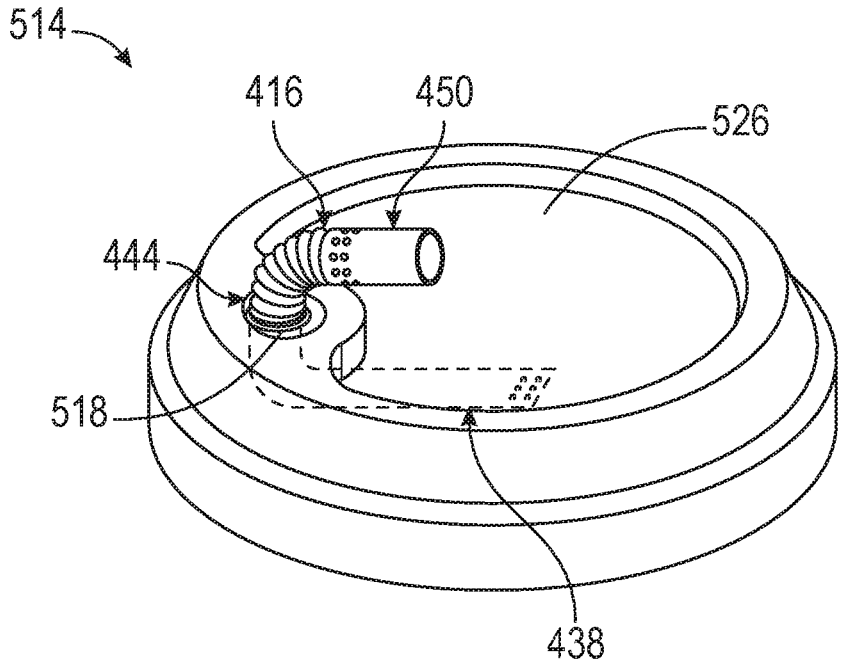
FIG. 14 is a front, top perspective view of the cooling straw inserted in the beverage container lid of FIG. 13, with the cooling straw in a bent position.

Referring to FIG. 14, the cooling straw 416 is shown inserted in the beverage container lid 514 shown in FIG. 13, with the cooling straw 416 in the bent position. As discussed above, in the bent position, the distal portion 438 and proximal portion 450 of the cooling straw 416 extend in directions that are substantially parallel to each other. In the bent position, the distal portion 438 and proximal portion 450 of the cooling straw also extend in directions that are substantially parallel to the cover portion 526 of the beverage container lid 514.

The distal portion 438 and proximal portion 450 are closer to the cover portion 526 of the beverage container lid 514 when the cooling straw 416 is in the bent position than when the cooling straw 416 is in the unbent position. Thus, when the cooling straw 416 is inserted in a beverage container lid 514 and is in the bent position, multiple lids 514 and cooling straws 416 may be arranged more compactly for shipping and/or storage purposes.

Figure 15:
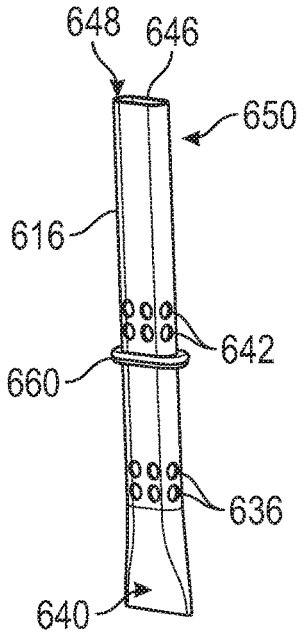
FIG. 15 is a front, top perspective view of another exemplary cooling straw according to the present disclosure.

Referring to FIG. 15, wherein like numerals represent like elements, an exemplary cooling straw 616 comprises a plurality of uptake holes 636 formed therein at a distal portion of the cooling straw 616. The distal portion is substantially at and/or near a distal end 640 of the cooling straw 616. Unlike conventional straws, the distal end 640 of the cooling straw 616 is closed. The uptake holes 636 may be approximately 0.3 mm to 1.3 mm in diameter size. The cooling straw 616 includes a plurality of cooling holes 642 at a proximal portion of the cooling straw 616. At an intermediate portion of the cooling straw 616 between the cooling holes 642 and the uptake holes 636, there is a fixing element 660.

Figure 16:
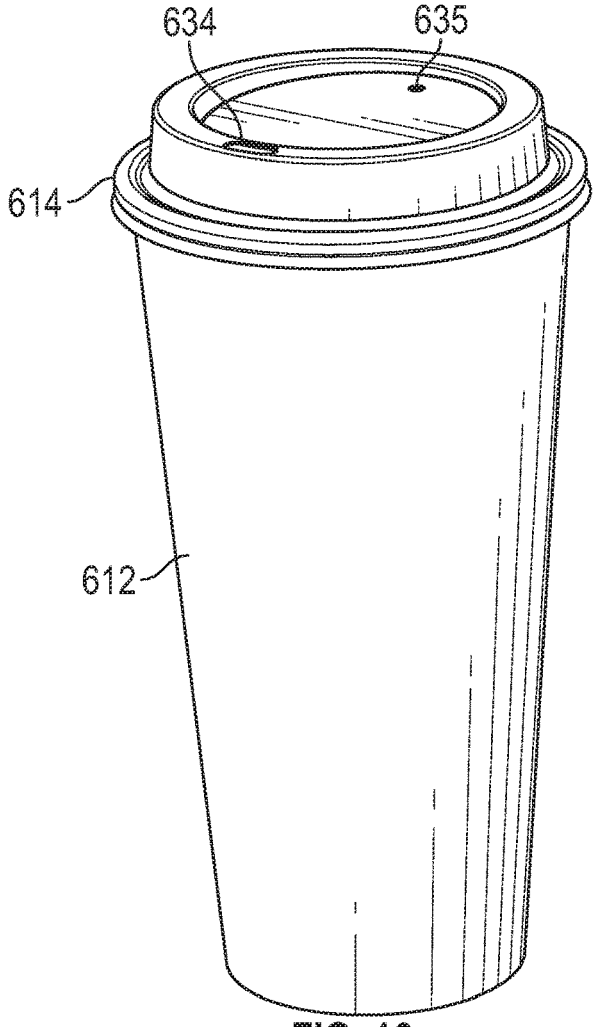
FIG. 16 is a front, top perspective view of another exemplary beverage container and lid according to the present disclosure.
Figure 17:
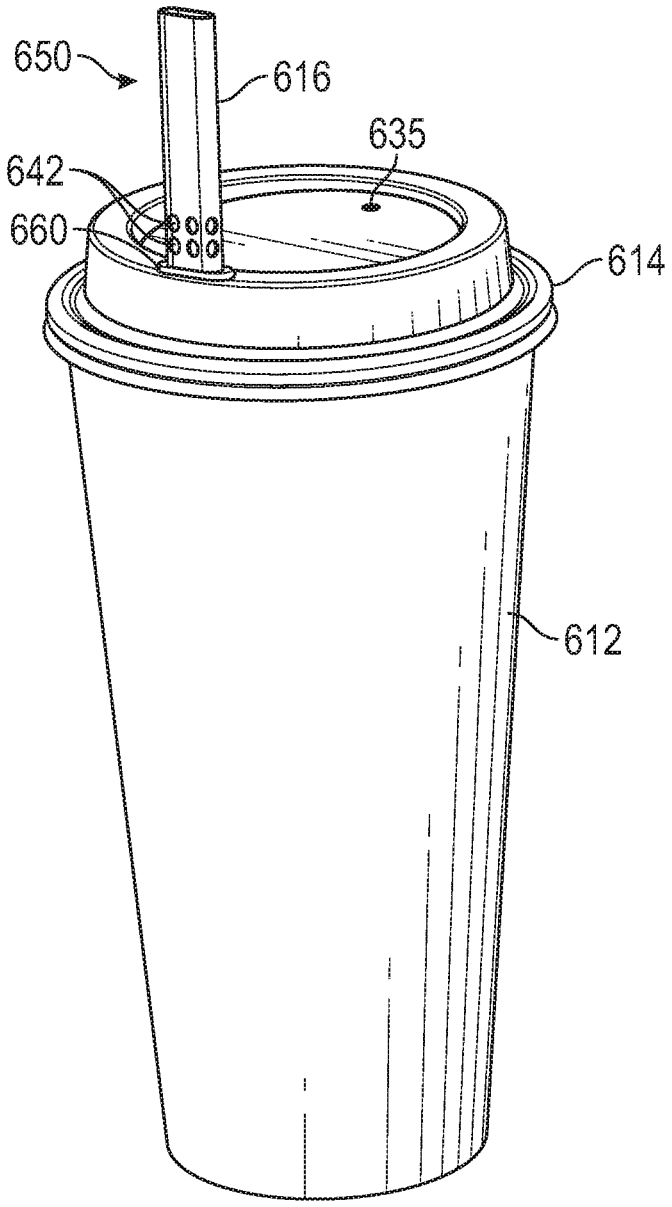
FIG. 17 is a front, top perspective view of the cooling straw of FIG. 15 inserted into the beverage container and lid of FIG. 16.
Figure 18:
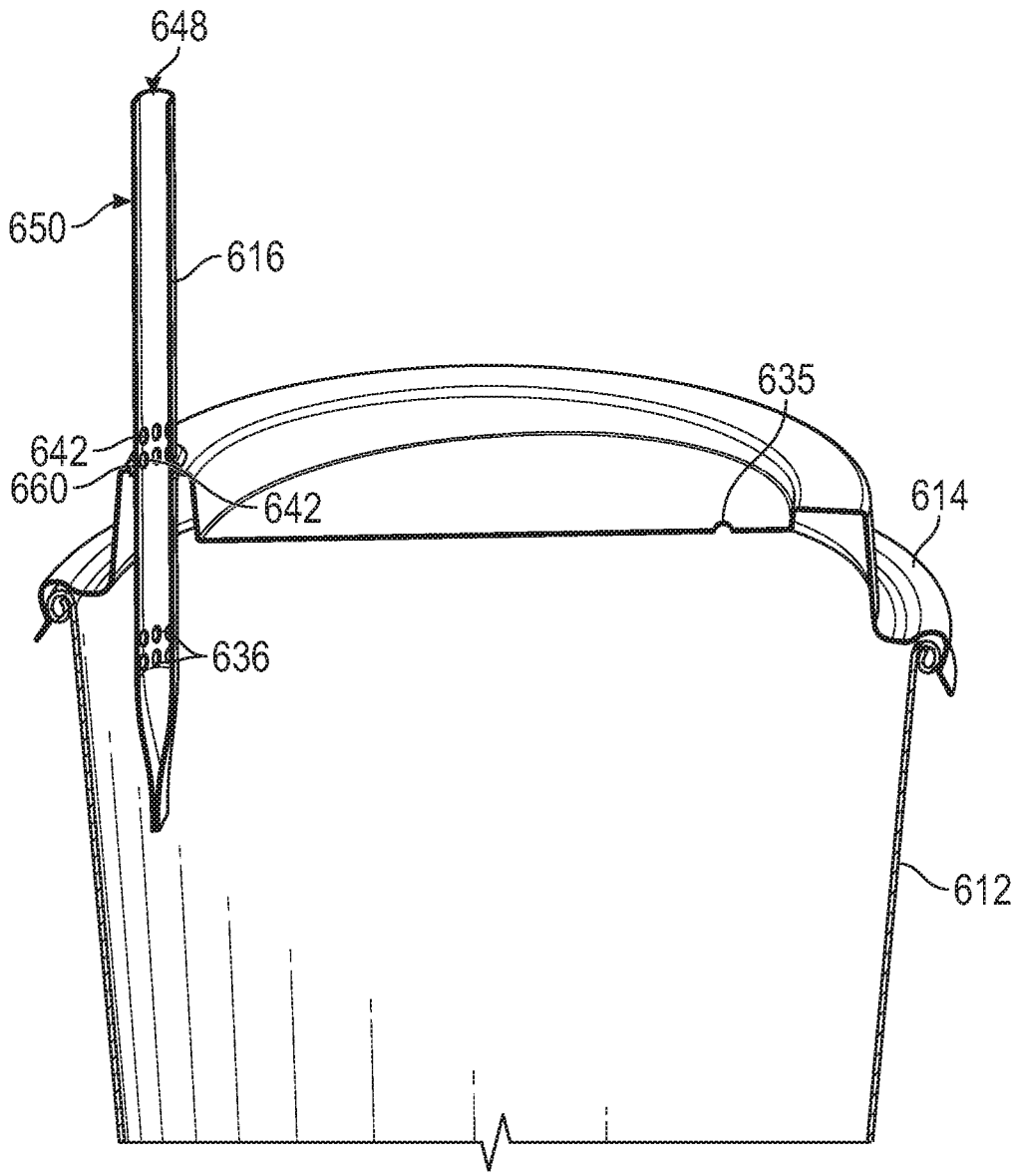
FIG. 18 is a front, right, top perspective and partial cross-section view of the cooling straw of FIG. 15 inserted into the beverage container and lid of FIG. 16.

Referring to FIG. 16, an exemplary beverage container comprising a cup 612 and lid 614 attached thereto is shown. The lid 614 comprises a drinking slot 634 and a vent hole 635. The beverage container may be operated by a consumer by placing his/her lips to the drinking slot 634 and tipping the beverage container so that the hot beverage flows into the consumer's mouth through drinking slot 634. Alternatively, the consumer may desire to use the cooling straw 616, shown in FIG. 15, with the beverage container cup 612 and lid 614. Specifically, the cooling straw 616 of FIG. 15 has a cross-sectional size and shape corresponding to the size and shape of the drinking slot 634 so that it may be inserted into the slot 634. The fixing element 660 on the cooling straw 616 is sized and shaped to be larger than the slot 634 to prevent the cooling straw 616 from being inserted entirely through the drinking slot 634 of the lid 614 beyond the position of the fixing element 660 on the cooling straw 616. The fixing element 660 may be configured to form a snap fit with the drinking slot 634 of the lid 614 so that the lid 614 retains the fixing element 660 and, thus, the cooling straw 616. The consumer may then operate or use the cooling straw 616 in a similar fashion as described above for other cooling straws disclosed herein.

While the drinking slot 634 and cooling straw 616 have been shown to have a substantially oval-like shape, it should be readily understood that the drinking slot 634 may be configured in any number of shapes or sizes and that the cooling straw 616 and fixing element 660 may be configured to have a corresponding shape and size. While the fixing element 660 has been shown at a particular location on the cooling straw 616, it should be readily understood that the fixing element 660 may also be configured to be at different positions along the length of the cooling straw 616.

Advantageously, when the cooling straw 616 is inserted in the lid 614 the beverage container is spill-proof, or near spill-proof, since there are no openings defined in the lid 614 that beverage may exit from. Although the vent hole 635 is an opening defined in the lid 614, those of ordinary skill in the art would understand how to configure the vent hole 635 sufficiently small in size to prevent or reduce the likelihood of beverage transfer therethrough. For example, the vent hole 635 may be the size of a pin hole, or smaller or larger than the size of a pin hole. While beverage is being consumed by a consumer via the cooling straw 616, the vent hole 635 may allow the pressure in the cup 612 to achieve equilibrium with an exterior pressure of the cup 612, or atmospheric pressure. Due to the size of the uptake holes 636 and cooling holes 642, a suction force generated by the consumer may be necessary in order for beverage to leave the cup 612 via the cooling straw 616. Advantageously, embodiments according to the present disclosure are less vulnerable to accidental beverage spills compared to conventional cups, lids and straws. The spill-proof, or near spill-proof, design is advantageous when a consumer is transporting the cup 612, lid 614 and cooling straw 616 when, for example, walking or traveling in an automobile.

As will be recognized by those of ordinary skill in the art, numerous changes and modifications may be made to the above-described disclosure without departing from the spirit or scope thereof. Accordingly, the particular embodiments described in this specification are to be taken as merely illustrative and not limiting. For instance, while the uptake holes and cooling holes described herein have been shown and described as being circular with sizes representing diameters of the circular shapes, it should be readily understood that the uptake holes and cooling holes may be configured to be other shapes having the same areas as those circular uptake holes and/or cooling holes.

What is claimed is:

1. A beverage container lid comprising:
- a cover portion for covering an interior chamber of a cup, the cover portion having a flange extending downwardly from the cover portion and including a mating geometry for securing the beverage container lid to a cup; and
- a cooling straw, the cooling straw comprising a distal portion, and intermediate portion and proximal portion, the distal portion including an uptake hole formed therein, and the proximal portion including a plurality of cooling holes formed therein;
- wherein the cooling straw is formed integrally with the cover portion;
- wherein the cooling straw comprises a first bendable section and a second bendable section; and
- wherein the intermediate portion is disposed between the first bendable section and the second bendable section, and wherein the intermediate portion has a substantially cylindrical tube shape.

2. The beverage container lid according to claim 1, wherein the first bendable section is configured to permit the proximal portion of the cooling straw to be moved to various positions and angles relative to the cover portion of the beverage container lid.

3. The beverage container lid according to claim 1, wherein the cooling straw is detachable from the cover portion.

4. A cooling straw for use with a beverage container lid configured for accommodating the cooling straw, the cooling straw comprising:
- a distal portion, a proximal portion, and an intermediate portion disposed between the distal portion and the proximal portion;
- wherein the distal portion includes a plurality of uptake holes formed therein;
- wherein the intermediate portion or the proximal portion includes a plurality of cooling holes formed therein;
- wherein the cooling straw comprises a first bendable section and a second bendable section; and
- wherein the intermediate portion is disposed between the first bendable section and the second bendable section, and wherein the intermediate portion has a substantially cylindrical tube shape.

5. The cooling straw according to claim 4, wherein the uptake holes are circular and have a diameter in the range of 0.3 mm to 1.3 mm.

6. The cooling straw according to claim 4, wherein the cooling holes are circular and have a diameter in the range of 0.3 mm to 1.3 mm.

7. The cooling straw according to claim 4, wherein the distal portion has a closed distal end.

8. The cooling straw according to claim 4, wherein the first bendable section is between one of the proximal portion or the distal portion and the intermediate portion.

9. The cooling straw according to claim 8, wherein the cooling straw has a linear shape when the cooling straw is in an unbent position.

10. The cooling straw according to claim 8, wherein the second bendable section is between the other of the proximal portion or the distal portion and the intermediate portion.

11. The cooling straw according to claim 10, wherein the distal portion and the proximal portion extend in directions that are parallel to each other when the cooling straw is in a bent position.

12. The cooling straw according to claim 4, wherein when a consumer generates a suction force in the cooling straw, air enters the cooling straw through the plurality of cooling holes.

13. A beverage container system comprising:
- a beverage container lid comprising:
  - a cover portion for covering an interior chamber of a cup;
  - a straw hole formed through the cover portion; and
  - a flange extending downwardly from the cover portion;
- a cooling straw comprising:
  - a distal portion, a proximal portion, and an intermediate portion disposed between the distal portion and the proximal portion,
  - wherein the distal portion of the straw includes a plurality of uptake holes formed therein;

wherein the proximal portion or the intermediate portion of the straw includes a plurality of cooling holes formed therein;

wherein the cooling straw comprises a first bendable section and a second bendable section; and wherein the intermediate portion is disposed between the first bendable section and the second bendable section, and wherein the intermediate portion has a substantially cylindrical tube shape.

14. The beverage container system according to claim 13, further comprising a recess accommodating the cooling straw therein.

15. The beverage container system according to claim 14, wherein the recess forms a snap-fit with the cooling straw to retain the cooling straw in the recess.

16. The beverage container system according to claim 13, further comprising a drinking slot formed through the cover portion.

17. The beverage container system according to claim 13, wherein the distal portion of the straw has a closed distal end.

18. The beverage container system according to claim 13, wherein the cooling straw has a substantially linear shape when the cooling straw is in an unbent position.

19. The beverage container system according to claim 13, wherein the distal portion and the proximal portion are movable between an unbent position in which the distal portion and the proximal portion extend in directions that are parallel to each other and a bent position in which the distal portion and the proximal portion extend in directions that are parallel to a plane defined by the cover portion.

20. The beverage container system according to claim 13, wherein the beverage container system is spill-proof such that generation of a suction force in the cooling straw is necessary in order to withdraw beverage fluid from the cup through the cooling straw.

* * * * *